United States Patent [19]

Egli

[11] Patent Number: 4,462,548

[45] Date of Patent: Jul. 31, 1984

[54] INJECTOR, IN PARTICULAR FOR INJECTING CONCRETE

[75] Inventor: Ernst Egli, Fahrweid, Switzerland

[73] Assignee: Aliva Aktiengesellschaft, Widen-Mutschellen, Switzerland

[21] Appl. No.: 386,480

[22] Filed: Jun. 9, 1982

[30] Foreign Application Priority Data

Jun. 10, 1981 [CH] Switzerland ..... 3786/81

[51] Int. Cl.[3] ..... B05B 3/00

[52] U.S. Cl. ..... 239/225

[58] Field of Search ..... 239/225, 264, 288, 587, 239/588

[56] References Cited

U.S. PATENT DOCUMENTS

| | | | |
|---|---|---|---|
| 4,244,523 | 1/1981 | Looper | 239/264 |
| 4,286,563 | 9/1981 | Fahim et al. | 239/587 |
| 4,351,478 | 9/1982 | Looper | 239/264 |
| 4,369,850 | 1/1983 | Barker | 239/264 |

*Primary Examiner*—John J. Love
*Assistant Examiner*—Jon M. Rastello
*Attorney, Agent, or Firm*—Lawrence Rosen

[57] ABSTRACT

When injecting concrete, the nozzle of the injecting device must perform a circular motion in order to avoid the formation of so-called beads. Since this is a laborious operation, the invention proposes an injecting device whose nozzle is provided with said motion by a mechanical drive. However, the feeding hose is not to perform said tumbling motion in order to the hazard of buckling, among other things. For said purpose serves a hydraulic motor (2) whose eccentric (1) provides the hose holding means (3) with a circular tumbling motion, said motion taking effect on the end of the feeding hose (6), said end being secured in hose holding means (3), and thus on the nozzle (7), whose mouth describes a circular motion. The hose holding means (3) is secured against twisting by the cross joint shaft (4). The four chains with links (8) arranged around the feeding hose with 90 degrees displacement against each other, jointly with the cross rings (9) prevent an excessive deflection of the feeding hose (6) and thus buckling of said hose, which would lead to increased wear and trouble during the injection of concrete. Said injecting device significantly facilitates the per-se laborious injecting of concrete, in particular of vaulted constructions.

3 Claims, 2 Drawing Figures

INJECTOR, IN PARTICULAR FOR INJECTING CONCRETE

Figures 1, 2:
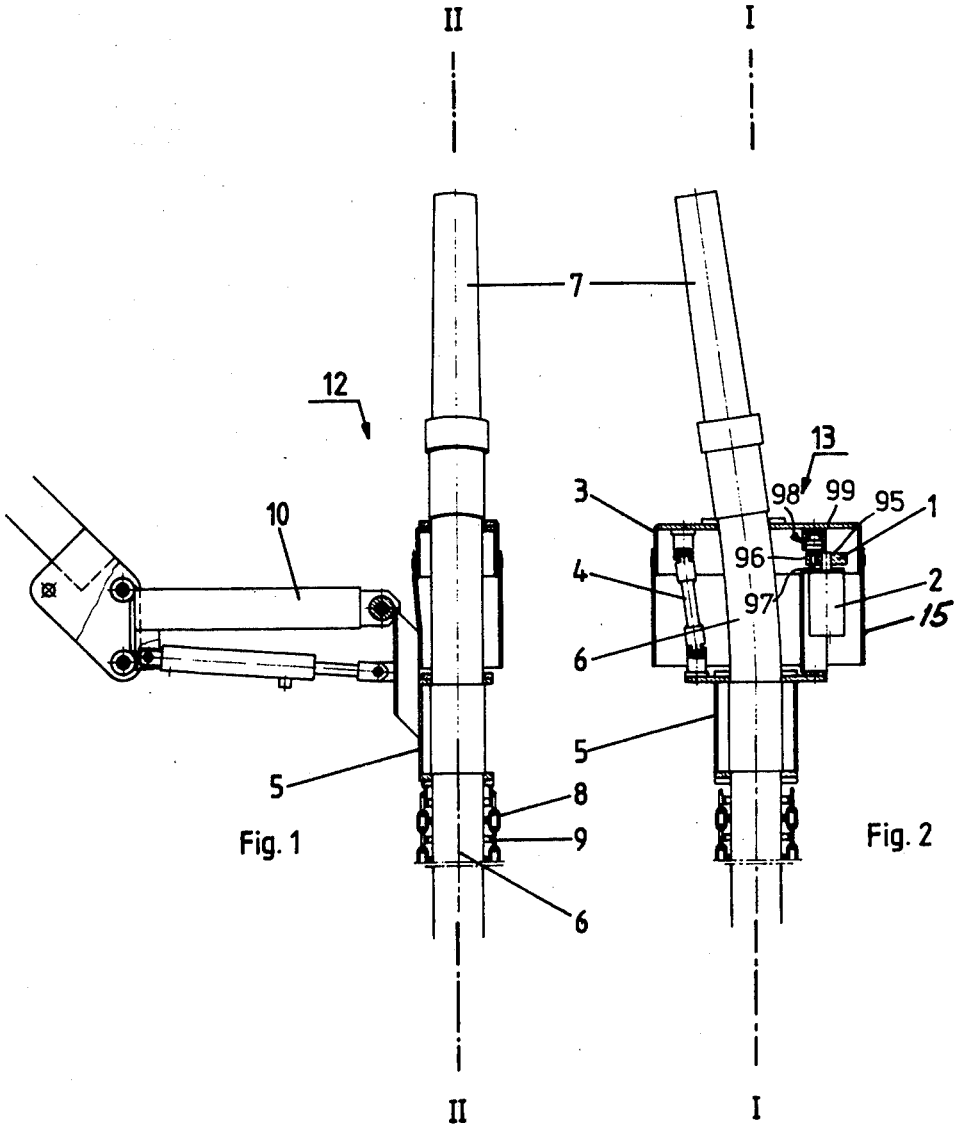

The present invention relates to an injecting device, in particular for injecting concrete.

Known injecting devices for injecting concrete as used, for example, in tunnel construction, are arranged at the end of an injector arm or a so-called injection manipulator, and guided by hand as explained, for example, in Swiss Pat. Spec. No. 613 015.

Furthermore, a concrete injection system is known in which the spray nozzle is capable of performing a tumbling motion. In said system, one point of the longitudinal axis of the nozzle is resting, whereas the remainder of the longitudinal axis of the nozzle describes a double circle, cone-shaped shell together with the axis of the material feeding hose. A tumbling hose, which poses the hazard of buckling at some point in such a system normally operated underground, is an interference not only for space reasons, but represents an unsafety factor during operation. This solution thus has significant drawbacks and not in great demand on construction sites, although it permits injection without forming beads. (EP 0009011).

It is the purpose of the present invention to provide such an injection device in connection with which a tumbling motion is performed exclusively with the nozzle and the end of the hose, which is exactly defined with respect to its length, whereas the remaining hose remains absolutely motionless up to a predetermined level. The point of the singe circular cone described by the tumbling axis of the injecting device is to be disposed on said plane.

Such an injecting device particularly for injecting concrete is characterized by a first hose holding means for stationarily fixing the concrete-feeding hose, and a second hose holding means for holding the end zone of the hose, as well as by means for moving the second hose holding means and with it the end zone of the hose in a circular path without rotating said end portion around its axis.

An embodiment of the object of the invention is explained in the following with the help of a drawing, in which:

FIG. 1 shows a lateral view of an injecting device with portions of the injector arm, partially in a cut view along line I—I of FIG. 2; and FIG. 2 shows a cut along line II—II of FIG. 1.

In FIG. 1, there is shown the free end of an injector arm 10 as specified in detail, for example in CH Pat. No. 613 015. An injecting device 12 is secured articulated on said end. Said injecting device 12 comprises, among other things, a nozzle 7 made, for example, of metal, which is placed over the end of a rubber-elastic feeding hose 6. A swiveling device 13 is arranged within the range of the end of feeding hose 6. Said device 13 has a device holding means 5 forming the stationary portion of swiveling device 13, and a hose holding means 3 movably connected with holding means 5. A motor, preferably a hydraulic motor 2, is provided on device holding means 5, said motor 2 having an eccentric carrying member 1 secured on its shaft 95. In particular, member 1 is provided with aperture 96 that is eccentric with respect to the rotational axis of motor shaft 95 so that as the latter operates to rotate member 1, aperture 96 will move in a circular path about shaft 95 as a center. A stump 97 extending from a ball bearing 98 engages in said eccentric aperture 96, said ball bearing 98 being secured with its outer ring 99 on hose holding means 3, as shown in FIG. 2. Furthermore, a cross joint shaft 4 having its one end connected with device holding means 5 and its other end with hose holding means 3 serves for supporting the two parts 5 and 3. FIG. 2 shows that the end of feeding hose 6 is connected with hose holding means 3, whereas slightly more to the rear, the device holding means 5 is also connected with the hose. Chains with links 8 are arranged in the longitudinal direction on hose 6 in order to prevent said hose 6 from buckling within the zone of device holding means 5. Cross rings 9 are arranged between said links in order to prevent tilting of feeding hose 6 beyond a certain acceptable degree, because with the desired maximum tilting, the links 8 rest against the cross rings 9, thus preventing any buckling of hose 6.

Such chains, however, can be used only with a non-tumbling hose. A rubber apron 15 is pulled over the hose holding means 3, covering the device. While with the injecting devices known until now, the feeding hose 5 is preforming a tumbling motion during injecting, which poses the hazard that the hose may bcukle at some point, the present invention serves the purpose of improving the injecting device in said regard. The hydraulic drive 2, whose eccentric 1 provides the hose holding means 3 with a circular tumbling motion, which takes effect on the end of feeding hose 6 secured in hose holding means 3 and thus on nozzle 7, permits the mouth of the nozzle to describe a circular motion. The amount of deflection can be adjusted on eccentric 1 to different radii by way of different borings. The hose holding means 3 is secured against twisting by cross joint shaft 4. The four chains with links 8, which are arranged around the feeding hose and displaced against each other by 90 degrees, jointly with cross rings 9 prevent an excessive deflection of feeding hose 6 and thus buckling of the hose. Such buckling would lead to increased wear and trouble during concrete injection operations.

The elasticity of the hose is exploited at the reversing point. The concrete-feeding hose 6 of the injecting device remains stationary in holding means 5, and does not tumble. Only this permits mounting a device protecting against buckling, preventing buckling of the feeding hose when injecting horizontally or downwardly, and thus premature wear.

Said injecting device significantly facilitates the perse laborious injection of concrete in particular in the construction of vaulted ceiling.

Only said injecting device permits trouble-free injecting with an injection manipulator!

I claim:

1. Injecting means, particularly for injecting concrete, including a feeding hose, a relatively fixed first means holding a portion of said hose, a second means movable relative to said first means in operative engagement with said hose downstream of said portion, and additional means for moving said second means in a circular path relative to said first means to move the downstream end of said hose without rotating said downstream end around its axis; said additional means including a first section comprising a motor and an eccentric device driven by said motor, said motor and said eccentric device being interposed between said first and second means and said additional means also includes a second section comprising holding means interposed between said first and second means to cooperate with said eccentric device to constrain movement of said second means to a circular path upon operation of said motor, said holding means includes a cross joint shaft extending between said first and second means; said hose being engaged with said second means at a point located between first and second locations of said second means where the latter is connected with the respective first and second sections of the additional means.

2. Injecting means as in claim 1 also including further means comprising chains and cross rings which prevent buckling of the hose.

3. Injecting means as in claim 2 in which the downstream end of the hose includes a nozzle that extends in a downstream direction from said second means.

* * * * *